United States Patent [19]

Deckert

[11] 4,199,863

[45] Apr. 29, 1980

[54] PILL CUTTER

[76] Inventor: Rosalie E. Deckert, 3417 Elmwood, Wichita, Kans. 67218

[21] Appl. No.: 923,791

[22] Filed: Jul. 12, 1978

[51] Int. Cl.[2] ..... A61J 3/00; B26B 17/00

[52] U.S. Cl. ..... 30/124; 83/167; 30/179

[58] Field of Search ..... 30/114, 123, 124, 179, 30/182, 131, 233, 120.1, 120.3, 120.5; 225/103, 104; 83/167

[56] References Cited

U.S. PATENT DOCUMENTS

| | | | |
|---|---|---|---|
| 1,201,067 | 10/1916 | Mason | 83/167 |
| 2,760,538 | 8/1956 | Palmieri | 30/120.1 |
| 3,639,981 | 2/1972 | Nowensky | 30/114 |

FOREIGN PATENT DOCUMENTS

| | | | |
|---|---|---|---|
| 2649064 | 5/1978 | Fed. Rep. of Germany | 30/124 |

*Primary Examiner*—Jimmy C. Peters

*Attorney, Agent, or Firm*—Lowe, Kokjer, Kircher, Wharton & Bowman

[57] ABSTRACT

A device for cutting a pill in half is the subject of the present invention. A base member is provided with movable retaining plates to accommodate different size pills and is also slotted to allow a blade to pass through the pill without contacting the base member. The blade is held in a normally raised position by a return spring which is yieldable to accommodate downward movement of the blade. The blade moves in a vertical plane normal to the plane of the base to assure a positive cutting action. After the pill is cut the spring returns the blade to its raised position.

5 Claims, 4 Drawing Figures

PILL CUTTER

This invention relates generally to cutlery and, more particularly, to a device for cutting a pill in half.

It is well known in the medical profession that both ethical and over-the-counter drugs are often administered in half dosages. The patient may utilize his hands, a kitchen knife or some other type of cutlery to divide a pill in half or even into fourths. For reasons of economy as well as the positive psychological impact on the patient in thinking that they are taking only a "half dosage," it may make it desirable to cut a pill in half. There has not, however, heretofore been a cutting device specifically designed for this purpose and the relatively crude methods employed in the prior art make it difficult for the patient, often result in an inaccurate dosage being taken and in many cases simply preclude the "half dosage" technique from being employed.

It is, therefore, a primary object of the present invention to provide a device for cutting a pill in half or in fourths for administration to a patient.

As a corollary to the above object, an important aim of the invention is to provide a device which can be used by the patient himself, thereby having a positive psychological impact on the patient.

As another corollary to the primary object, a principal objective of the invention is to help reduce the cost of medicines administered in pill form by allowing pills to be produced in larger sizes, reducing the number of sizes which a pill manufacturer must make and reducing the need for "children's dosages" of certain common, over-the-counter drugs.

It is also an aim of the present invention to permit a doctor to prescribe medicine in desired increasing dosages such as one-fourth pill, one-half pill followed by a whole pill where such an approach is medically indicated.

Still a further object of the invention is to provide a device for cutting a pill in half or in fourths which will assume virtually 100% accuracy in the cutting operation.

Other objects of the invention will be made clear or become apparent from the following description and claims when read in light of the accompanying drawings wherein:

Figure 1:
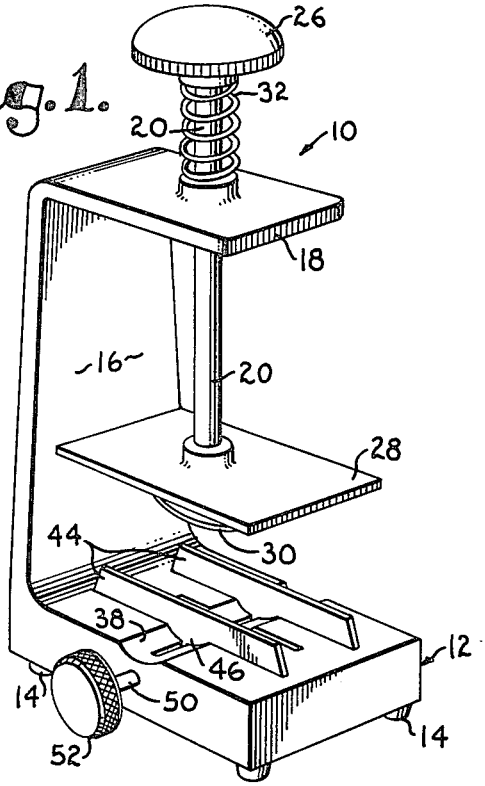
FIG. 1 is a perspective view of the pill cutting device according to the present invention.

Referring initially to FIG. 1, the cutlery device of the present invention is designated generally by the numeral 10. Device 10 comprises a generally rectangular base plate 12 provided with feet 14 of rubber-like material. Base plate 12 is integrally formed with a vertical support 16 which in turn is integral with a horizontal arm 18. Arm 18 extends from support 16 in the same direction as base 12 and lies in a plane generally parallel to the plane of the base but in spaced relationship above the latter.

Figure 2:
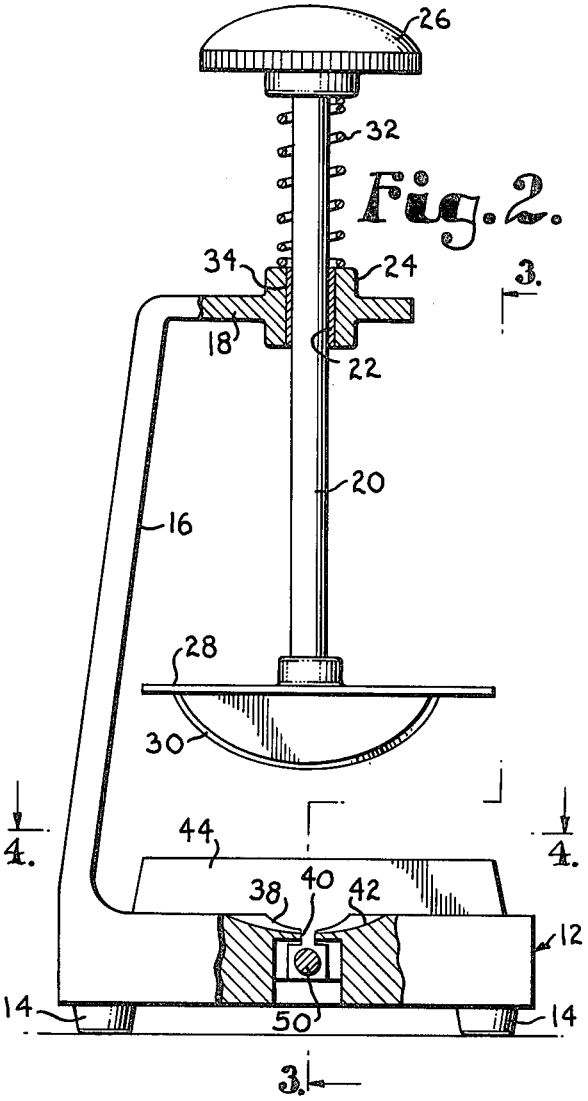
FIG. 2 is an enlarged side elevational view with portions cut away and shown in cross section for purposes of illustration.

As best illustrated on FIG. 2, a vertical plunger rod 20 is reciprocally mounted in an opening 22 presented by a collar 24 formed in arm 18. Rod 20 is provided with a rounded head 26 at one end and a horizontal shield 28 at the opposite end. A cutting blade 30 of generally semicircular configuration is rigid with shield 28 on the bottom side of the latter. Manifestly, blade 30, shield 28 and rod 20 present a guillotine assembly which is held in a raised position relative to base 12 by a coil spring 32. As can be seen from viewing FIG. 2, collar 24 is provided with a spline 34 which is complementally received within a flute 36 (FIG. 3) of rod 20.

Referring now to details of construction of base member 12, from FIGS. 1 and 2 it is seen that a concave recessed area 38 extends across the face of the base. Area 38 is provided with a groove 40 (FIG. 2) disposed at the bottom of the area and extending substantially along its length. A slot 42 bisects the area 38 and groove 40.

First and second retainer plates both of which are indicated by the numeral 44, are disposed in parallel on base member 12 and in contiguous relationship with the latter. Each of the retainer plates is characterized by a downwardly extending ear 46 which generally conforms to the configuration of recessed area 38. Each of the plates 44 also has a downwardly extending appendage 48 which projects through groove 40 and presents a threaded opening. A double threaded screw 50 extends through openings in base member 12 and also through the openings presented by appendages 48 of plates 44. Screw 50 has an enlarged knob 52 at one end for turning it. Manifestly, screw 50 is rotatable within the openings that receive it in base 12.

Figure 3:
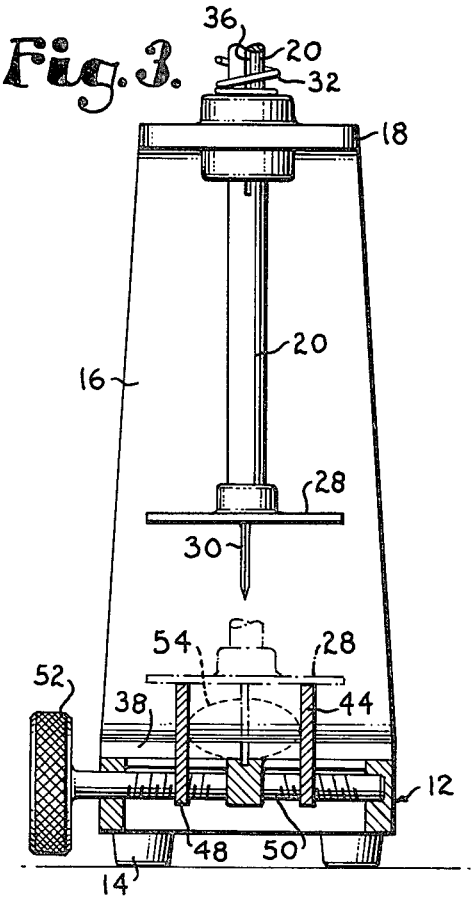
FIG. 3 is a vertical elevational view looking in the direction of line 3—3 in FIG. 2.

The device 10 is used to cut a pill such as that designated by the numeral 54 and shown in broken lines in FIG. 3 into either two or four pieces. Pill 54 is first placed between plates 44 and knob 52 is turned to bring the plates into abutment with the edges of the pill. Downward pressure is applied by the operator, contacting head 26 thereby lowering rod 20 and causing blade 30 to engage pill 54. The downward action is continued until shield 28 engages plates 44. At this point in the downward movement, the tip of blade 30 will reside in the slot 42 beneath the surface of recessed area 38 thereby assuring complete severance of the two halves of pill 54. Upon release of head 26, spring 32 will return rod 20 to its raised position to permit the removal of the halved pill.

It will be appreciated that spline 34 and flute 36 cooperate to assure alignment of blade 30 with slot 42. By virtue of the spline 34, rod 20 is held against rotation to preclude any damage to the blade which would occur if misalignment between the blade and groove 40 was possible. The stop action of shield 28 striking plates 44 also assures that the cutting edge of the blade will never contact base member 12 which would of course dull the blade. It is also to be noted that shield 28 is of a size to completely cover the area between plates 44 so as to prevent any splattering of pill particles during the cutting action.

Figure 4:
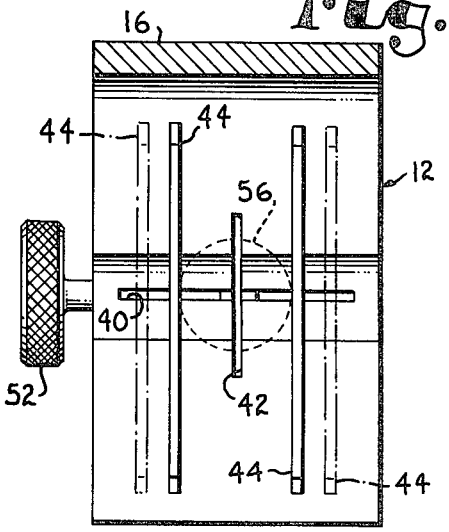
FIG. 4 is a horizontal cross-sectional view looking in the direction of arrows 4-4 in FIG. 2.

Pill 54 is of generally elliptical configuration, but the device 10 may easily accommodate a pill of a different configuration such as round pill 56 shown in FIG. 4. Knob 52 is simply rotated to cause plates 44 to come closer together until the plates abut the edges of the different sized pill. The cutting action is of course the same as described above.

It has been found that the generally vertical movement of rod 20 in a plane perpendicular to the plane of base member 12 provides a particularly efficient cutting action which will reduce the possibility of breaking the pill into other than two equally sized pieces. It should also be appreciated that by virtue of the device 10, one of the halves of the pill after it is cut, may be replaced into the recessed area 38 and plates 44 brought into engagement with the pill half so that this half may be reduced to fourths.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described my invention, I claim:

1. A device for cutting a pill in half comprising:

a base; a surface on said base to support a pill; opposed retainer plates mounted on said base for centering a pill, means for moving said plates toward and away from each other in substantially equal amounts for accomodating different size pills; and blade means disposed above the base and movable downwardly between said plates to cut said pill in half.

2. A device as set forth in claim 1, wherein said means hold said plates in a desired position.

3. A device as set forth in claim 1, wherein said blade means is movable in a vertical plane that is normal to the plane of said base.

4. A device as set forth in claim 3, wherein is included stop means coupled with said blade means to preclude contact between the base means and the blade means.

5. A device as set forth in claim 3, wherein said blade means is normally disposed in a raised position above said base means and wherein is included spring means for returning the blade means to its normal position after a downward cutting movement.

* * * * *